US006301458B1

(12) United States Patent
Mori et al.

(10) Patent No.: US 6,301,458 B1
(45) Date of Patent: Oct. 9, 2001

(54) IMAGE FORMING APPARATUS

(75) Inventors: Tokihiko Mori, Kunitachi; Toshiaki Tanaka, Fukaya, both of (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/631,668

(22) Filed: Aug. 3, 2000

(51) Int. Cl.[7] ..... G03G 15/00
(52) U.S. Cl. ..... 399/167; 399/117
(58) Field of Search ..... 399/116, 117, 399/159, 162, 167

(56) References Cited

U.S. PATENT DOCUMENTS

| | | | | |
|---|---|---|---|---|
| 5,132,728 | * | 7/1992 | Suzaki et al. | 399/167 |
| 5,579,093 | * | 11/1996 | Wagner et al. | 399/159 |
| 5,740,500 | * | 4/1998 | Hashimoto | 399/117 X |
| 5,745,825 | * | 4/1998 | Okawa et al. | 399/117 |
| 5,774,767 | * | 6/1998 | Shibata et al. | 399/167 |
| 6,055,399 | * | 4/2000 | Omura | 399/167 |

FOREIGN PATENT DOCUMENTS

| | | |
|---|---|---|
| 2-130562 | 5/1990 | (JP) . |
| 2-225862 | 9/1990 | (JP) . |
| 2-287577 | 11/1990 | (JP) . |
| 3-80264 | 4/1991 | (JP) . |

* cited by examiner

*Primary Examiner*—Sandra Brase
(74) *Attorney, Agent, or Firm*—Foley & Lardner

(57) ABSTRACT

An image forming apparatus according to the present invention comprises a photoconductor drum rotatable around a drum shaft, an exposure unit for forming an image on the drum, a developing unit for supplying a developing agent to the image formed by the exposure unit, thereby forming a developing agent image, a transfer belt for transferring the developing agent image formed by the developing unit to paper, a drive motor having a drive shaft mounted with a coupling into which the distal end portion of the drum shaft is inserted such that the drive shaft and the drum shaft are coaxially connected to each other by means of the coupling, and a plurality of split pieces formed on the drum shaft and/or the coupling and adapted to be elastically deformed in a direction such that the split pieces contract or expand when the drum shaft is inserted into the coupling.

20 Claims, 6 Drawing Sheets

IMAGE FORMING APPARATUS

BACKGROUND OF THE INVENTION

The present invention relates to an image forming apparatus adapted for use as, for example, an electrophotographic color copying machine of the tandem type.

An electrophotographic color copying machine of the tandem type comprises a plurality of image forming sections that are arranged in the direction of paper transportation. Each image forming section includes a photoconductor drum and a developing unit, which are integrally unitized to form a process unit.

A plurality of drive motors are arranged on the back surface side in the body of the copying machine. A drum shaft of each photoconductor drum is releasably connected for rotation to a drive shaft of its corresponding drive motor.

Toner images of different colors are formed individually on the photoconductor drums of the process unit. The toner images of the individual colors on the drums are transferred successively to the surface of paper that is transported by means of a transfer belt, whereupon a color image is formed on the paper.

The process unit requires maintenance operation after the formation of every tens of thousands of images. Accordingly, the process unit is designed so that it can be loaded into or unloaded from the copying machine body. In starting the maintenance operation, therefore, the process unit can be drawn out of the machine body.

When the process unit is inserted into the color copying machine, the respective drum shafts of its photoconductor drums are connected individually to the respective drive shafts of the drive motors. This connection should be reliable.

The rotation of the drive motors is subject to unevenness or vibration. If the uneven or vibratory rotation is transmitted to the drum shafts of the photoconductor drums through the drive shafts, the resulting images are blurred and lowered in quality.

As is described in Jpn. Pat. Appln. KOKAI Publications Nos. 2-130562, 2-225862, 2-287577, and 3-80264, therefore, arrangements are conventionally used such that a drum shaft and a drive shaft are connected to each other by means of a non-coaxial spur or helical gear train.

Although the drum shaft and the drive shaft can be securely connected to each other in the conventional arrangements, however, the non-coaxial gear train is used for the connection, so that backlash is entailed. Infinitesimal vibration is generated even in helical gears in which impact is dispersed between their teeth. This vibration is transmitted to the photoconductor drums, thereby exerting a bad influence upon the image quality.

In order to solve this problem, a novel arrangement has been developed in which a drum shaft and a drive shaft are coaxially connected to each other by means of a coupling.

In the case of this coupling system, however, the drum shaft cannot be inserted into the coupling if there is relative dislocation between the drum shaft and the drive shaft. In the case of the tandem type, in particular, a plurality of drum shafts are designed to be inserted individually into a plurality of couplings, so that smooth insertion is difficult.

If the drum shaft of a photoconductor drum is inserted into the coupling by force, moreover, images are subject to dimensional unevenness or blur, and excessive load acts on the bearing of the drum shaft. Thus, the bearing is deteriorated, so that satisfactory image quality cannot be ensured.

BRIEF SUMMARY OF THE INVENTION

The present invention has been contrived in consideration of these circumstances, and its object is to provide an image forming apparatus designed so that a shaft of an image carrying body can be securely inserted into a coupling with ease to ensure good image quality.

An image forming apparatus according to the present invention comprises: an image carrying body rotatable around a shaft; image forming means for forming an image on the image carrying body; developing means for supplying a developing agent to the image formed by the image forming means, thereby forming a developing agent image; transfer means for transferring the developing agent image formed by the developing means to a transfer medium; drive means having a drive shaft mounted with a coupling into which the distal end portion of the shaft of the image carrying body is inserted such that the drive shaft and the shaft of the image carrying body are coaxially connected to each other by means of the coupling; and an elastically deformable portion formed on the shaft of the image carrying body and/or the coupling and adapted to be elastically deformed in a direction such that the deformable portion contracts or expands when the shaft of the image carrying body is inserted into the coupling.

Another image forming apparatus according to the invention comprises: a plurality of image forming sections including a plurality of image carrying bodies rotatable around a shaft each, a plurality of image forming means for forming images individually on the image carrying bodies, and a plurality of developing means for supplying developing agents of different colors to the images formed by the image forming means, thereby forming developing agent images, the image carrying bodies and the developing means being integrally unitized to form a process unit; transfer means for successively transferring the developing agent images formed by the image forming sections to a transfer medium; a plurality of drive means each having a drive shaft mounted with a coupling into which the distal end portion of the shaft of each image carrying body is inserted such that the drive shaft and the shaft of the image carrying body are coaxially connected to each other by means of the coupling; and elastically deformable portions formed individually on the respective shafts of the image carrying bodies and/or the couplings and adapted to be elastically deformed in a direction such that the deformable portions contract or expand when the respective shafts of the image carrying bodies are inserted individually into the couplings.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

An embodiment of the present invention will now be described with reference to the accompanying drawings.

Figure 1:
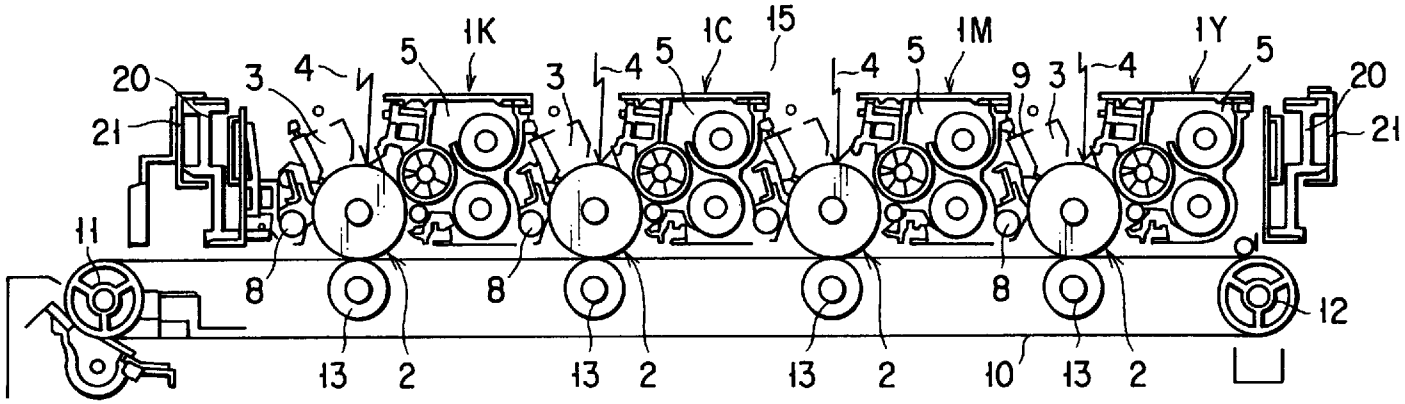
FIG. 1 is a front view showing the internal construction of an electrophotographic apparatus according to an embodiment of the invention.
Figure 2:
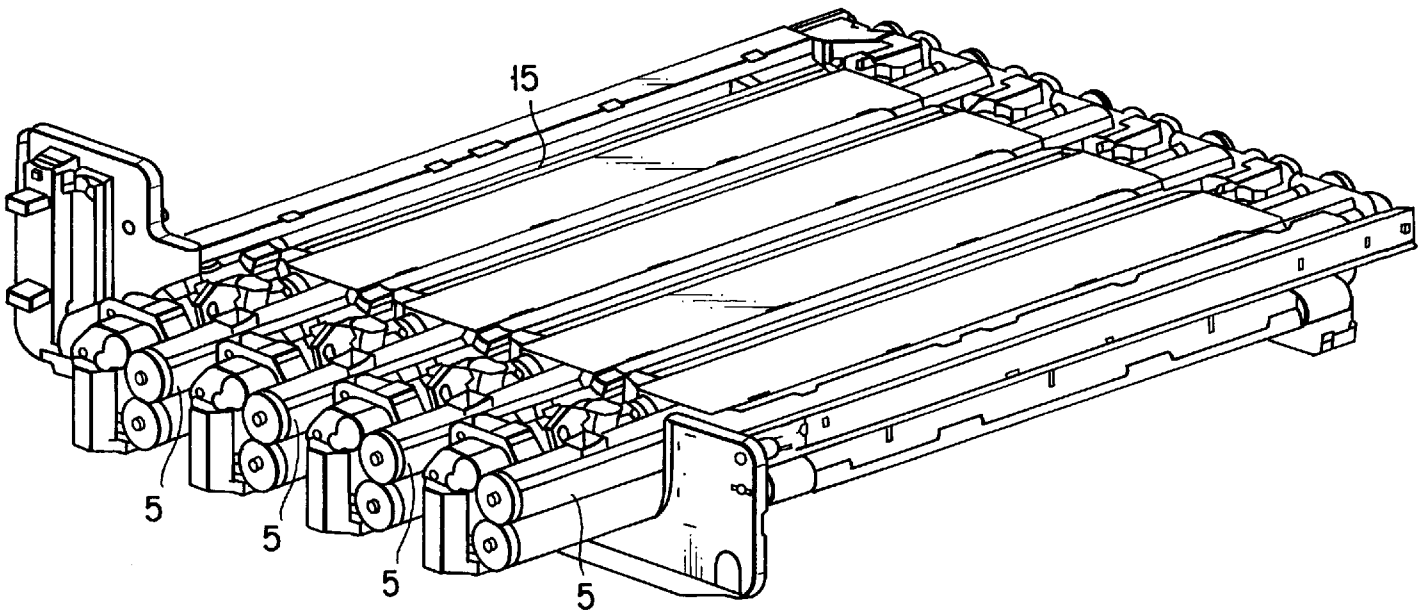
FIG. 2 is a perspective view showing the internal construction of the electrophotographic apparatus of FIG. 1.

FIG. 1 is a front view showing the internal construction of an electrophotographic color copying machine of the tandem type as an image forming apparatus according to an embodiment of the invention.

This electrophotographic color copying machine is provided with a plurality of (or four) image forming sections 1K, 1M, 1C and 1K, which are arranged in a given direction.

Each of the image forming sections 1Y, 1M, 1C and 1K has a photoconductor drum 2 for use as an image carrying body. The drum 2 is surrounded by a main charger 3, exposure unit 4 for use as latent image forming means, developing unit 5 as developing means, cleaning unit 8, and de-electrifier 9, which are arranged successively in the rotating direction of the drum 2.

The main charger 3 charges the surface of the photoconductor drum 2 to a given potential, while the exposure unit 4 forms an electrostatic latent image that corresponds to an original image.

The respective developing units 5 of the image forming sections 1Y, 1M, 1C and 1K are stored with yellow (Y), magenta (M), cyan (C), and black (K) toners, respectively. The toners of the different colors are supplied individually from the developing units 5 to effect developing.

The cleaning unit 8 serves to remove the toner or developing agent that remains on the photoconductor drum 2, and the de-electrifier 9 to remove the surface potential remaining on the photoconductor drum 2.

The photoconductor drums 2 are underlain by a transfer belt 10 that serves as transfer means for transferring toner images on the drums 2 to paper as a transfer medium. The belt 10 is stretched between a driving roller 11 and a driven roller 12. A plurality of support rollers 13 for supporting the belt 10 are arranged between the rollers 11 and 12.

In image forming operation, the respective surfaces of the photoconductor drums 2 of the image forming sections 1K, 1M, 1C and 1K are charged by means of the main chargers 3, whereupon electrostatic latent images corresponding to the original image are formed individually on the surfaces of the charged drums 2. As the drums 2 rotate, the latent images are delivered to the developing units 5, and the toners of the individual colors as developing agents are supplied from the developing units 5, whereupon the toner image of the individual colors are formed. As this is done, on the other hand, paper as an object of transfer is fed by means of a paper feeder (not shown), and is transported to the photoconductor drums 2 of the image forming sections 1K, 1M, 1C and 1K by means of the transfer belt 10. Thereupon, the toners of the individual colors are transferred successively to the paper, thereby forming a color image on the paper. The paper, having the color image thereon, is delivered to a fixing unit (not shown), whereupon the toner images are fixed to the paper. Thereafter, the paper is discharged.

The image forming sections 1K, 1M, 1C and 1K are unitized to form a process unit 15.

Figure 3:
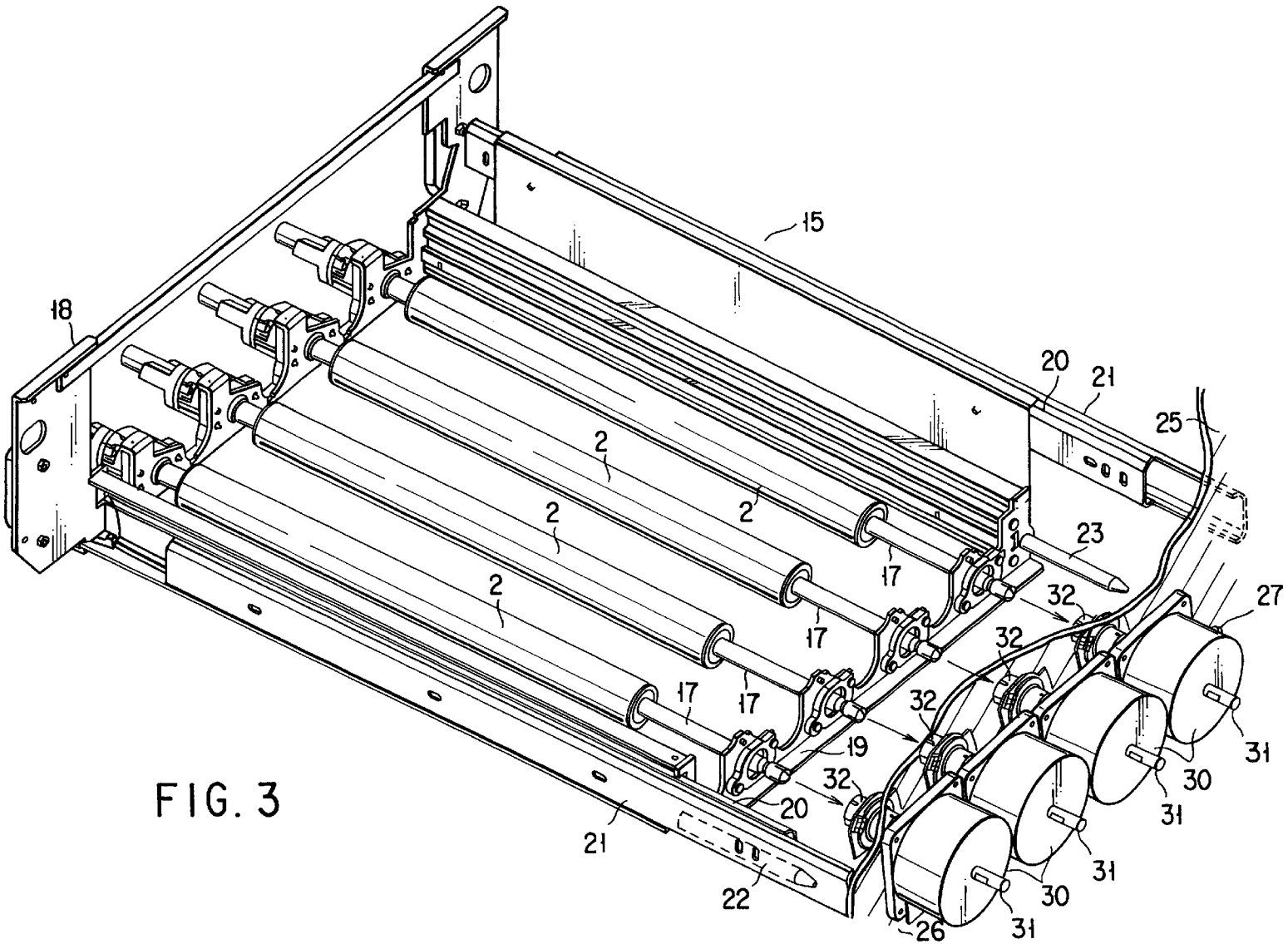
FIG. 3 is a perspective view showing a configuration for photoconductor drums and drive motors.

More specifically, as shown in FIG. 3, the front end side of a shaft 17 the photoconductor drum 2 of each of the image forming sections 1K, 1M, 1C and 1K is rotatably supported on a front frame 18 of the unit 15, and the rear end side on a rear frame 19 of the unit 15.

The process unit 15, constructed in this manner, is mounted so that it can be loaded into or unloaded from the body of the copying machine. More specifically, slide rails 20 are attached individually to the opposite side face portions of the unit 15 and are slidably inserted in their corresponding guide rails 21 in the copying machine body.

Pins 22 and 23 are formed protruding individually from the opposite side portions of the rear frame 19, while sockets for the pins 22 and 23 are bored through a rear frame 25 of the copying machine body. When the pins 22 and 23 are inserted in the sockets 26 and 27, respectively, the process unit 15 is positioned with respect to its transverse direction. The unit 15 is positioned with respect to its longitudinal direction by means of its front frame 18 and a front frame (not shown) of the copying machine body.

On the other hand, a plurality of drive motors 30 for rotating the photoconductor drums 2 are arranged in a line on the rear frame 25 of the copying machine body. The shaft 17 of each drum 2 is coaxially connected to the distal end portion of a drive shaft 31 of each corresponding motor 30 by means of a coupling 32.

Figure 4:
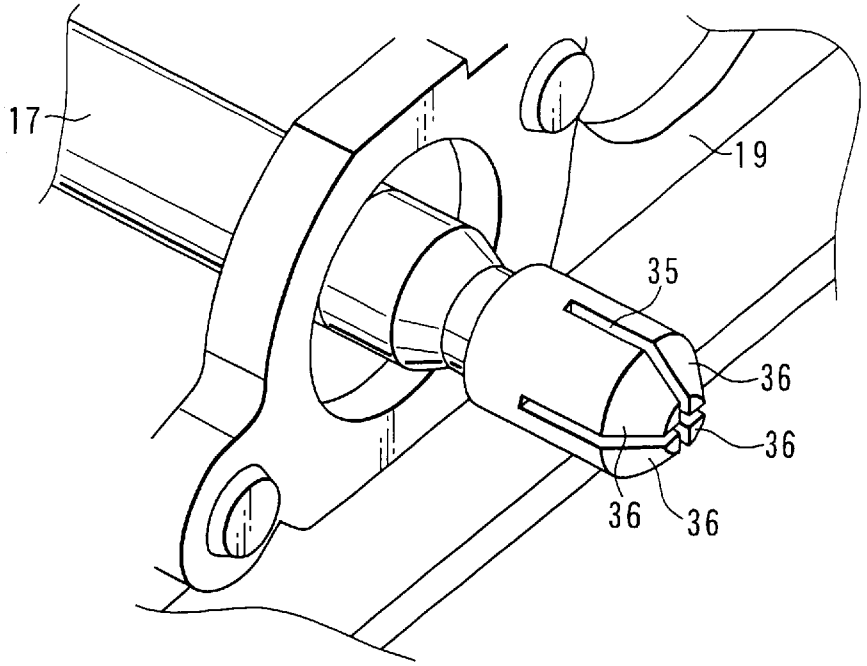
FIG. 4 is a perspective view showing a distal end structure of a drum shaft of a photoconductor drum.

FIG. 4 is a perspective view showing the distal end portion of one of the photoconductor drums 2.

The distal end portion of each drum shaft 17 has a plurality of slits 35 that are formed in the shape of a cross, as viewed in the direction of the arrow. Thus, the distal end portion of the shaft 17 divided into a plurality of (four) split pieces 36, which can be elastically deformed so that they contract inward.

The following is a description of operation for mounting the process unit 15.

Figure 5:
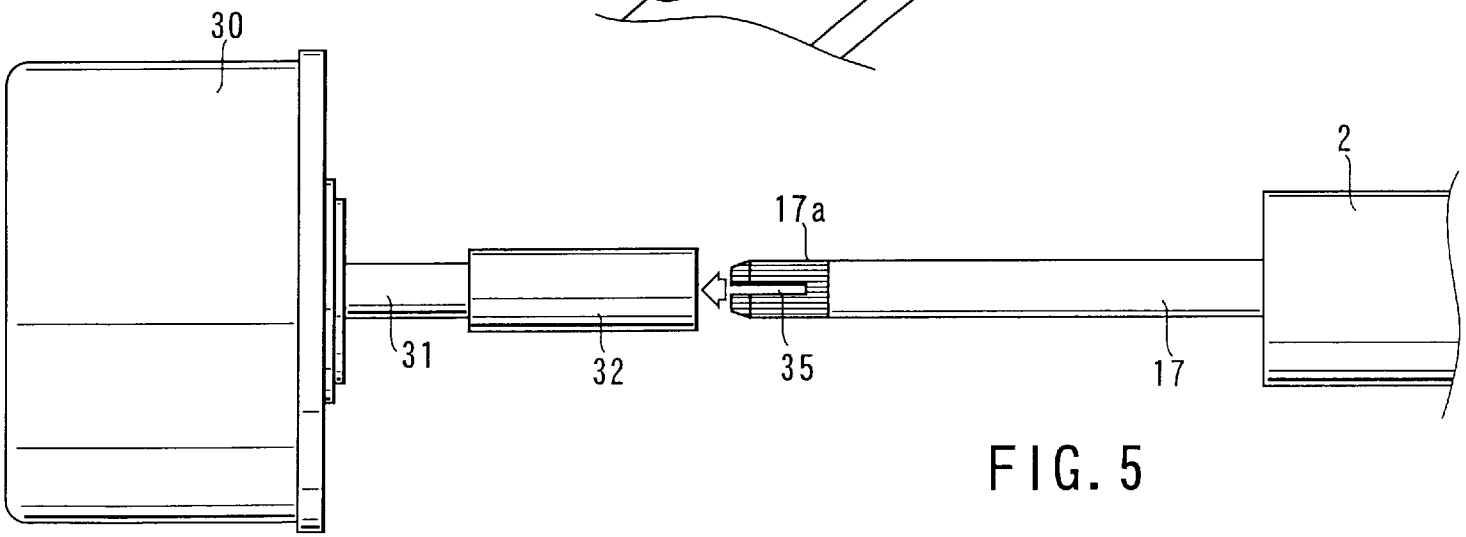
FIG. 5 is a view illustrating the way the drum shaft of the photoconductor drum is connected to a drive shaft of the drive motor.

In mounting the process unit 15, the slide rails 20 on the opposite sides of the unit 15 are first fitted into their corresponding guide rails 21 of the copying machine body, and the unit 15 is pushed into the copying machine body. If the process unit 15 is pushed to a given depth, the respective distal end portions of the shafts 17 of the photoconductor drums 2 face the couplings 32 of the drive shafts 31 of the drive motors 30, individually, as shown in FIG. 5. If the unit 15 in this state is further pushed in, the respective distal end portions of the drum shafts 17 are inserted individually into the couplings 32 of the drive shafts 31, and the shafts 31 and 17 are connected coaxially. When the drive motors 30 are rotated after this connection, the photoconductor drums 2 are rotated by means of the drive shafts 31, couplings 32, and drive shafts 17.

Internal teeth (not shown) are formed on the inner peripheral surface of each coupling 32, and external teeth 17*a* on the outer peripheral surface of the distal end portion of each drum shaft 17. When the distal end portion of the shaft 17 is inserted into the coupling 32, the external teeth 17*a* mesh with the internal teeth of the coupling 32 so that the turning moment of the coupling 32 is transmitted to the shaft 17.

In connecting the drive shafts 31 and the drum shafts 17, the couplings 32 and the shafts 17 may be relatively dislocated in some cases. If such a dislocation occurs, the drum shafts 17 cannot be easily inserted into the couplings 32. As mentioned before, however, the slits 35 are cut in the distal end portion of each shaft 17 to form the split pieces 36 thereon. If the couplings 32 and the drum shafts 17 are relatively dislocated, therefore, the split pieces 36 on the distal end portion of each shaft 17 can be contracted inward as the shaft 17 is inserted into its corresponding coupling 32.

Accordingly, the shafts 17 of the photoconductor drums 2, unlike the conventional ones, can be smoothly inserted into the couplings 32 without compulsion. Thus, the drums 2 can be rotated satisfactorily, so that good image quality can be secured.

According to the embodiment described above, the four slits 35 are cut in the shape of a cross in the distal end portion of each drum shaft 17 to form the split pieces. Only if the shaft 17 is strong enough to resist the transmission torque of power from the drive shaft 31, however, six or eight slits may be formed to increase the split pieces in number so that the relative dislocation between the drive shaft 31 and the drum shaft 17 can be absorbed more efficiently. In consideration of component costs that depend on restrictions on the work for the shaft 17, it is most reasonable to form the four slits 35 in the shape of a cross.

Figure 6:
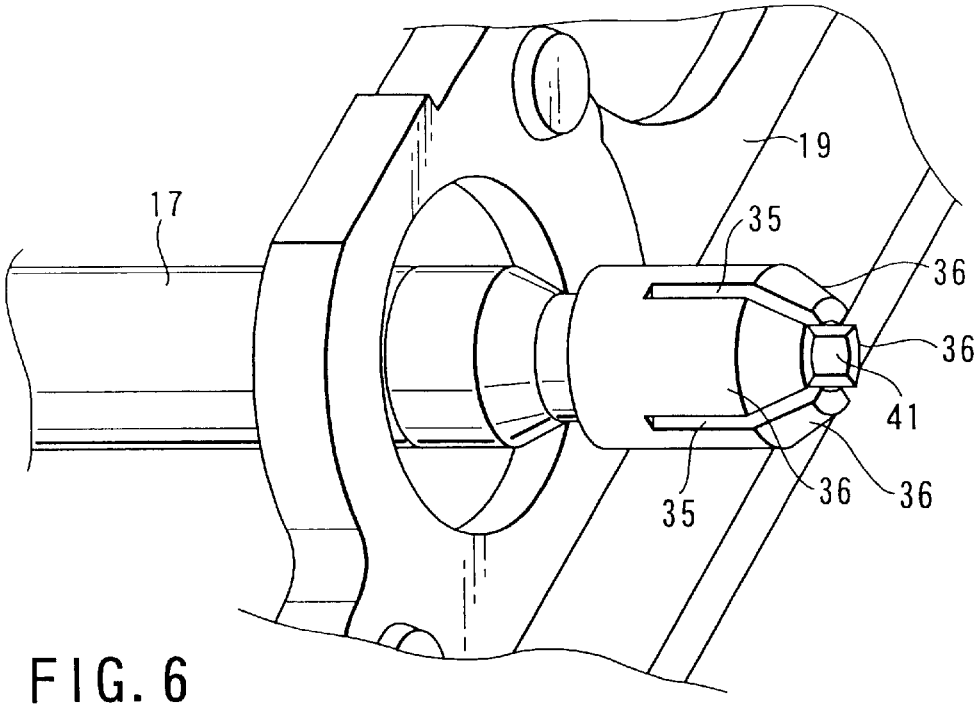
FIG. 6 is a perspective view showing a first modification of the distal end structure of the drum shaft of the photoconductor drum.

FIG. 6 is a perspective view showing a first modification of the distal end portion of the shaft 17 of each photoconductor drum 2.

In this first modification, the distal end portion of each drum shaft 17 is formed having a cylindrical spot-faced portion 41 as well as slits 35. Thus, the elasticity of split pieces 36 on the distal end of the shaft 17 is improved. If there is relative dislocation between the shaft 17 and its corresponding drive shaft 31, therefore, it can be absorbed so that the distal end portion of the shaft 17 can be inserted into a coupling 32 more securely and easily.

If the center of the distal end of the drum shaft 17 is spot-faced too much, the wall thickness of the split pieces 36 on the distal end of the shaft 17 is so small that the pieces 36 may possibly be broken.

Figure 7:
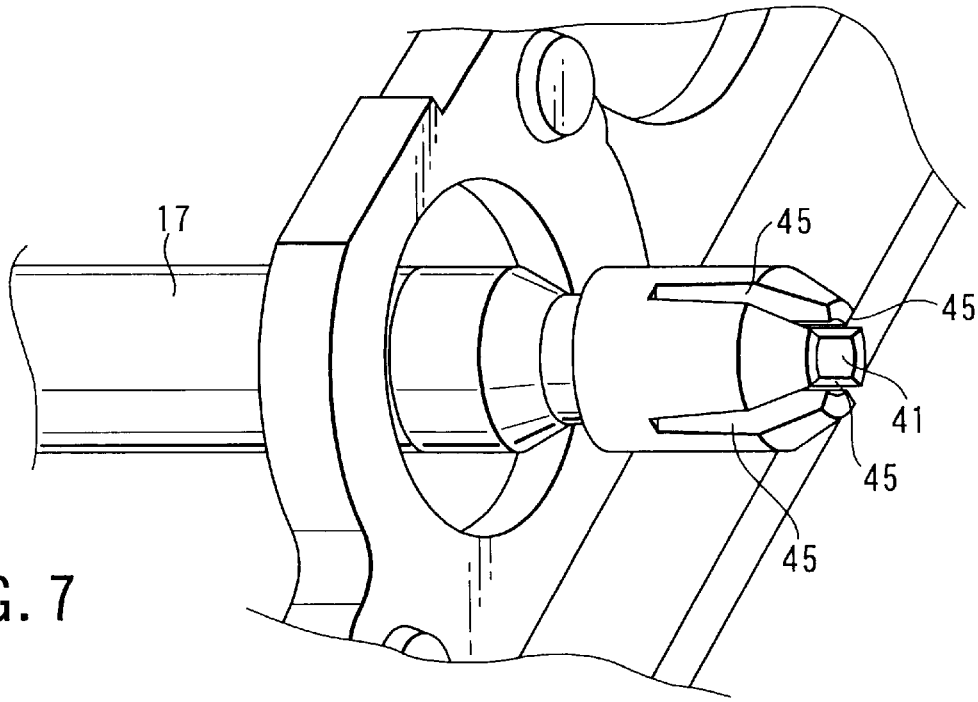
FIG. 7 is a perspective view showing a second modification of the distal end structure of the drum shaft of the photoconductor drum.

FIG. 7 is a perspective view showing a second modification of the distal end portion of the shaft 17 of each photoconductor drum 2.

In this second modification, the central portion of the distal end of each drum shaft 17 is formed so that slits 45 gradually spread form the proximal portion toward the distal end portion, as well as being spot-faced. According to this second modification, the elasticity of split pieces 36 on the distal end of the shaft 17 is further improved, so that the shaft 17 can be inserted into a coupling 32 more smoothly with smaller possibility of breakage.

In the first embodiment and the first and second modifications described above, the coupling 32 or the drum shaft 17 may be formed of a molded component of polyacetal or the like that is liable to elastic deformation, and the other of a metallic material such as stainless steel. In this case, the shaft 17 can be inserted into the coupling 32 more smoothly, and dragging of the coupling 32 and the shaft 17 after the insertion can be restrained.

Figure 8:
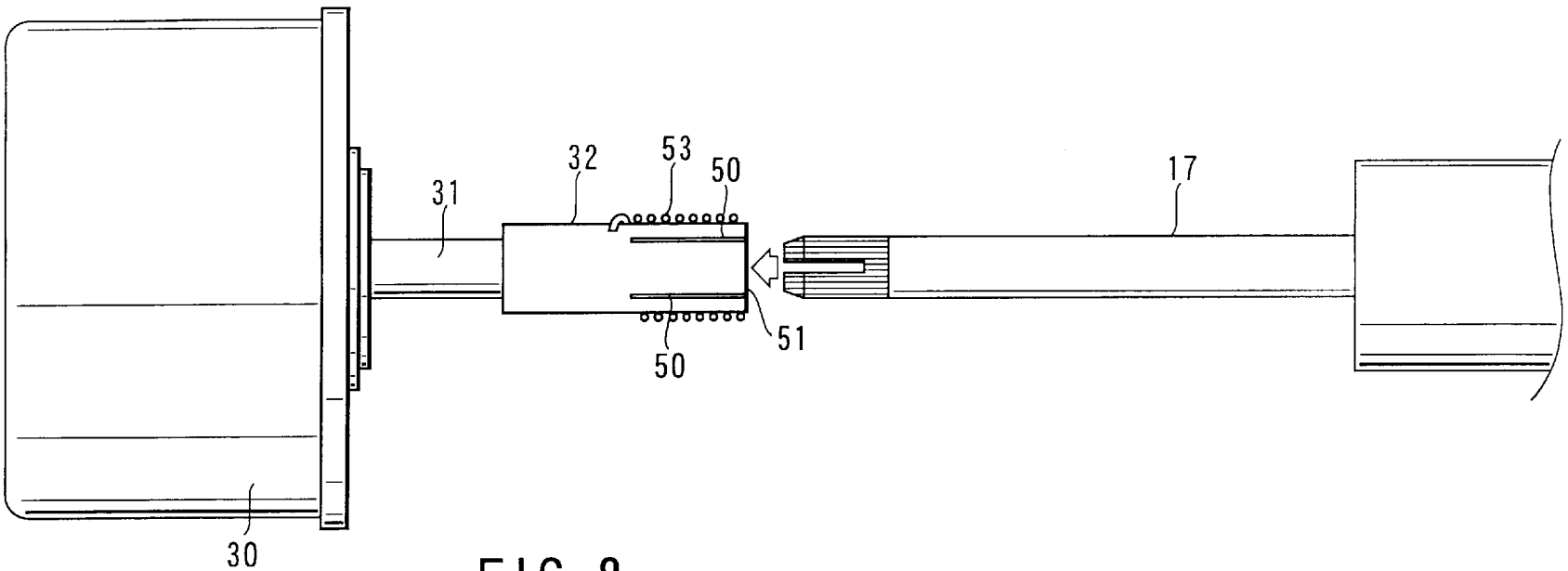
FIG. 8 is a view showing a modification of a coupling for connecting the drive shaft of the drive motor and the drum shaft of the photoconductor drum.

FIG. 8 shows a modification of the coupling 32 that is mounted on the drive shaft 31 of each drive motor 30.

Figure 9:
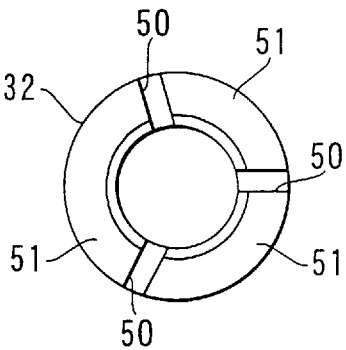
FIG. 9 is a front view of the coupling shown in FIG. 8.

In this modification, as is also shown in FIG. 9, three slits 50 are formed on the distal end side of the coupling 32 at given spaces in the circumferential direction thereof. Thus, a plurality of (three) split pieces 51 are formed on the distal end side of the coupling 32. The outer peripheral portion of the split pieces 51 of the coupling 32 is wound with a coil spring 53.

If there is any misalignment between the drum shaft 17 and the drive shaft 31 when the shaft 17 is inserted into the coupling 32, according to this modification, the split pieces 51 of the coupling 32 are elastically deformed so that they spread out, thereby absorbing the misalignment. Thus, the drum shaft 17 can be inserted more smoothly into the coupling 32.

After the drum shaft 17 is inserted into the coupling 32, the coil spring 53 securely fixes the shaft 17 and the drive shaft 31, so that the shaft 17 can be rotated without any errors.

Figure 10:
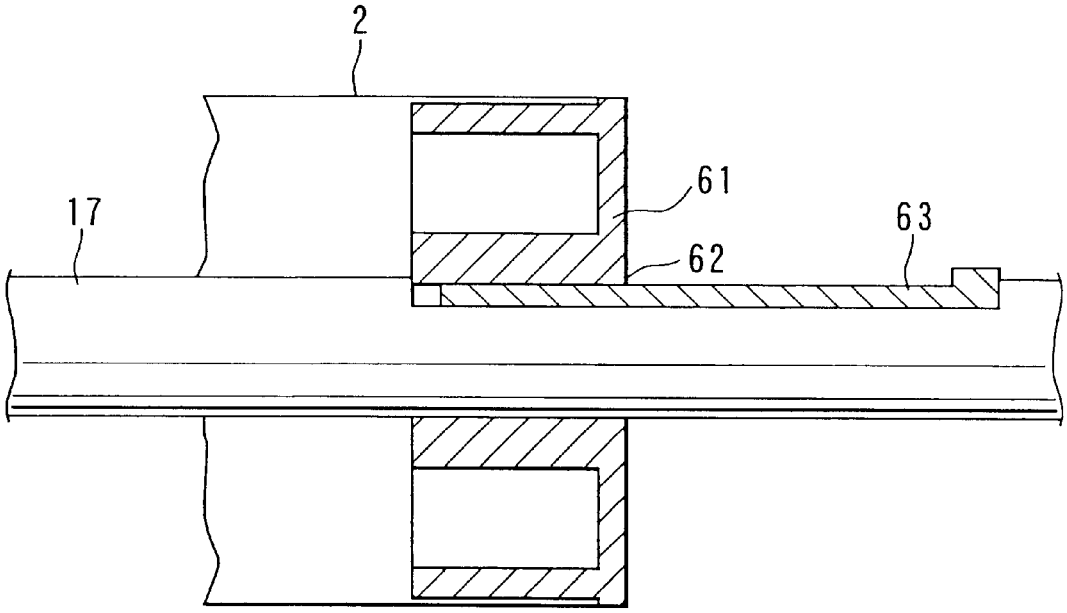
FIG. 10 is a sectional view showing a structure for connection between a flange of the photoconductor drum and the drum shaft.

FIG. 10 is a sectional view showing an attachment structure for the photoconductor drum 2 and the drum shaft 17.

Since the photoconductor drum 2 requires periodic maintenance, it is designed to be separable from the drum shaft 17.

A flange 61 is provided on each end portion of the photoconductor drum 2, and a mounting hole 62 is formed in its central portion. The drum shaft 17 is inserted in the hole 62 of the flange 61 to be fitted therein. A press-fit member 63 is pressed into a gap between the hole 62 of the flange 61 and the drum shaft 17. The press-fit member 63 serves to restrain backlash between the shaft 17 and the hole 62 of the flange 61, thereby preventing a bad influence upon the image quality.

If there is a substantial backlash between the photoconductor drum 2 and the drum shaft 17, power transmission from the shaft 17 to the drum 2 is subject to a time lag or is unstable, so that the image quality is adversely affected.

Figure 11:
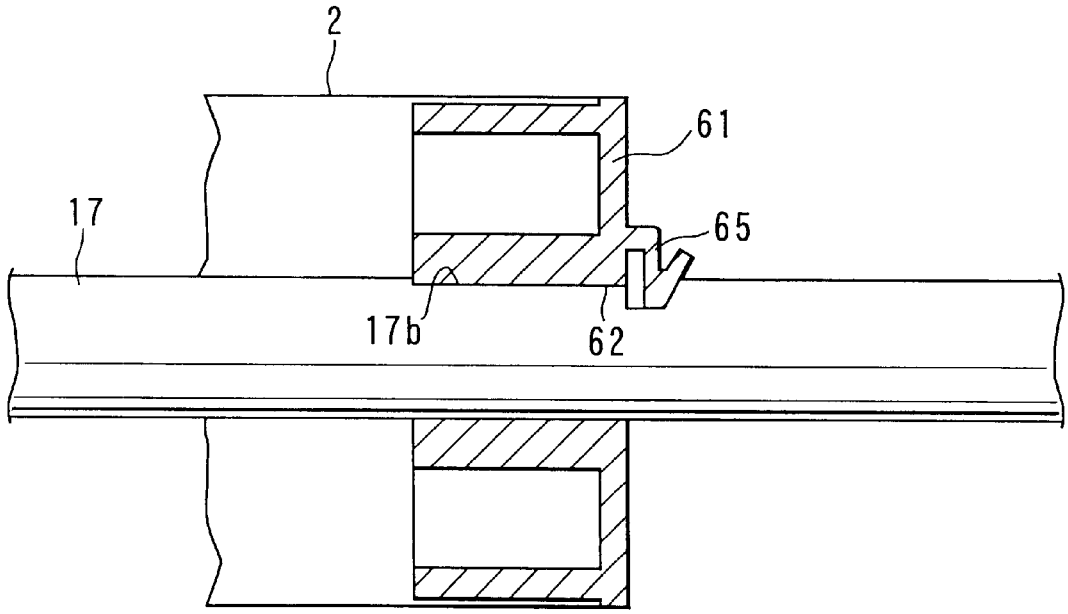
FIG. 11 is a sectional view showing a modification of the structure for connection between the flange of the photoconductor drum and the drum shaft.

FIG. 11 is a sectional view showing another example of the attachment structure for the photoconductor drum 2 and the drum shaft 17.

In this example, a hook portion 65 is formed integrally on the flange 61 of the photoconductor drum 2. When the drum shaft 17 is inserted into the mounting hole 62 of the flange 61 and reaches a predetermined position, the hook portion 65 is fitted in a recess 17*b* in the surface of the shaft 17, thereby holding the shaft 17. Thus, backlash between the drum 2 and the shaft 17 can be restrained to lessen the influence upon the image quality.

The structures shown in FIGS. 10 and 11 serve to restrain backlash between the photoconductor drum 2 and the drum shaft 17. These structures are also applicable to cases where backlash between paper feed rollers, heat rollers of a fixing unit, and rollers of a transfer belt, in an electronic copying machine, and their respective shafts is expected to be restrained.

Although the color image forming apparatus of the tandem type has been described in connection with the foregoing embodiment, the present invention is not limited to this embodiment, and may be also applied to a monochromatic image forming apparatus.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An image forming apparatus comprising:

an image carrying body rotatable around a shaft;

image forming means for forming an image on the image carrying body;

developing means for supplying a developing agent to the image formed by the image forming means, thereby forming a developing agent image;

transfer means for transferring the developing agent image formed by the developing means to a transfer medium;

drive means having a drive shaft mounted with a coupling into which the distal end portion of the shaft of the image carrying body is inserted such that the drive shaft and the shaft of the image carrying body are coaxially connected to each other by means of the coupling; and an elastically deformable portion formed on the shaft of the image carrying body and/or the coupling and adapted to be elastically deformed in a direction such that the deformable portion contracts or expands when the shaft of the image carrying body is inserted into the coupling.

2. An image forming apparatus according to claim 1, wherein said elastically deformable portion is composed of a plurality of split pieces formed on the distal end portion of the shaft of the image carrying body.

3. An image forming apparatus according to claim 2, wherein said plurality of split pieces are divided by forming a plurality of slits in the peripheral wall portion of the shaft of the image carrying body at given spaces in the circumferential direction thereof.

4. An image forming apparatus according to claim 3, wherein the distal central portion of said split pieces is cylindrically spot-faced.

5. An image forming apparatus according to claim 3, wherein the width of each said slit gradually increases from the proximal portion thereof toward the distal end portion.

6. An image forming apparatus according to claim 1, wherein said elastically deformable portion is composed of a plurality of split pieces formed on the distal end portion of the coupling.

7. An image forming apparatus according to claim 6, wherein said plurality of split pieces are divided by forming a plurality of slits in the peripheral wall portion of the coupling at given spaces in the circumferential direction thereof.

8. An image forming apparatus according to claim 7, wherein the outer peripheral portion of the split pieces of the coupling is wound with a spring member.

9. An image forming apparatus according to claim 1, wherein the shaft of said image carrying body or said coupling is formed of a molded component capable of elastic deformation, and the other of a metallic material.

10. An image forming apparatus comprising:

an image carrying body rotatable around a shaft;

image forming means for forming an image on the image carrying body;

developing means for supplying a developing agent to the image formed by the image forming means, thereby forming a developing agent image;

transfer means for transferring the developing agent image formed by the developing means to a transfer medium;

drive means having a drive shaft mounted with a coupling into which the distal end portion of the shaft of the image carrying body is inserted such that the drive shaft and the shaft of the image carrying body are coaxially connected to each other by means of the coupling; and an elastically deformable portion formed on the shaft of the image carrying body and/or the coupling and adapted to be elastically deformed in a direction such that the deformable portion contracts or expands when the shaft of the image carrying body is inserted into the coupling, wherein said image carrying body has flange portions on the opposite end portions thereof, individually, each said flange portion having a mounting hole in the center into which the shaft is to be inserted in a manner such that a press-fit member is pressed into a gap formed between the mounting hole and the shaft.

11. An image forming apparatus comprising:

an image carrying body rotatable around a shaft;

image forming means for forming an image on the image carrying body;

developing means for supplying a developing agent to the image formed by the image forming means, thereby forming a developing agent image;

transfer means for transferring the developing agent image formed by the developing means to a transfer medium;

drive means having a drive shaft mounted with a coupling into which the distal end portion of the shaft of the image carrying body is inserted such that the drive shaft and the shaft of the image carrying body are coaxially connected to each other by means of the coupling; and an elastically deformable portion formed on the shaft of the image carrying body and/or the coupling and adapted to be elastically deformed in a direction such that the deformable portion contracts or expands when the shaft of the image carrying body is inserted into the coupling, wherein said image carrying body has flange portions on the opposite end portions thereof, individually, each said flange portion having a mounting hole in the center into which the shaft is to be inserted in a manner such that a spring portion formed integrally on the flange portion elastically presses the shaft against the inner surface of the mounting hole, thereby holding the shaft under pressure.

12. An image forming apparatus comprising:

a plurality of image forming sections including a plurality of image carrying bodies rotatable around a shaft each, a plurality of image forming means for forming images individually on the image carrying bodies, and a plurality of developing means for supplying developing agents of different colors to the images formed by the image forming means, thereby forming developing agent images, the image carrying bodies and the developing means being integrally unitized to form a process unit;

transfer means for successively transferring the developing agent images formed by the image forming sections to a transfer medium;

a plurality of drive means each having a drive shaft mounted with a coupling into which the distal end portion of the shaft of each image carrying body is inserted such that the drive shaft and the shaft of the image carrying body are coaxially connected to each other by means of the coupling; and elastically deformable portions formed individually on the respective shafts of the image carrying bodies and/or the couplings and adapted to be elastically deformed in a direction such that the deformable portions contract or expand when the respective shafts of the image carrying bodies are inserted individually into the couplings.

13. An image forming apparatus according to claim 12, wherein said elastically deformable portion is composed of a plurality of split pieces formed on the distal end portion of the shaft of the image carrying body.

14. An image forming apparatus according to claim 13, wherein said plurality of split pieces are divided by forming a plurality of slits in the peripheral wall portion of the shaft of the image carrying body at given spaces in the circumferential direction thereof.

15. An image forming apparatus according to claim 14, wherein the distal central portion of said split pieces is cylindrically spot-faced.

16. An image forming apparatus according to claim 14, wherein the width of each said slit gradually increases from the proximal portion thereof toward the distal end portion.

17. An image forming apparatus according to claim 12, wherein said elastically deformable portion is composed of a plurality of split pieces formed on the distal end portion of the coupling.

18. An image forming apparatus according to claim 17, wherein said plurality of split pieces are divided by forming a plurality of slits in the peripheral wall portion of the coupling at given spaces in the circumferential direction thereof.

19. An image forming apparatus according to claim 18, wherein the outer peripheral portion of the split pieces of the coupling is wound with a spring member.

20. An image forming apparatus according to claim 12, wherein the shaft of said image carrying body or said coupling is formed of a molded component capable of elastic deformation, and the other of a metallic material.

* * * * *